US010215462B2

(12) United States Patent
Sanhaji

(10) Patent No.: US 10,215,462 B2
(45) Date of Patent: Feb. 26, 2019

(54) DEVICE FOR SEPARATING OIL FROM A REFRIGERANT FLUID

(71) Applicant: SNAP-ON CLIMATE SOLUTIONS S.R.L., Correggio, (RE) (IT)

(72) Inventor: Rahhali Sanhaji, Sesto Fiorentino (IT)

(73) Assignee: SNAP-ON CLIMATE SOLUTIONS S.R.L., Correggio (IT)

( * ) Notice: Subject to any disclaimer, the term of this patent is extended or adjusted under 35 U.S.C. 154(b) by 0 days.

(21) Appl. No.: 15/553,374

(22) PCT Filed: Feb. 24, 2016

(86) PCT No.: PCT/IB2016/051013

§ 371 (c)(1),
(2) Date: Aug. 24, 2017

(87) PCT Pub. No.: WO2016/135653

PCT Pub. Date: Sep. 1, 2016

(65) Prior Publication Data

US 2018/0073788 A1 Mar. 15, 2018

(30) Foreign Application Priority Data

Feb. 25, 2015 (IT) ..... PI2015A0010

(51) Int. Cl.
*F25B 43/02* (2006.01)
*F25B 45/00* (2006.01)

(52) U.S. Cl.
CPC ..... *F25B 43/02* (2013.01); *F25B 45/00* (2013.01); *F25B 2400/051* (2013.01); *F25B 2700/19* (2013.01)

(58) Field of Classification Search
CPC ..... F25B 43/02; F25B 2700/19; F25B 2400/051; F25B 45/00
See application file for complete search history.

(56) References Cited

U.S. PATENT DOCUMENTS

| | | | | |
|---|---|---|---|---|
| 2003/0196450 | A1 | 10/2003 | Higami | 62/475 |
| 2004/0000163 | A1 | 1/2004 | Renders | 62/475 |
| 2010/0269538 | A1 | 10/2010 | Suzuki et al. | 62/470 |

OTHER PUBLICATIONS

International Search Report dated Jul. 11, 2016, issued to International Application No. PCT/IB2016/051013.

*Primary Examiner* — Ana M Vazquez
(74) *Attorney, Agent, or Firm* — Stein IP, LLC

(57) ABSTRACT

A device for separation of oil particles by a coolant for air conditioning systems comprises a hollow container body and an inlet arranged to make enter the hollow container body a coolant, with oil particles, mainly in liquid phase and have a temperature $T_1$. The device also comprises a outlet located upper part of the hollow container body and arranged to cause protrude coolant regenerated in vapour phase by the hollow container body. is also provided a heating coil arranged in the hollow container body and containing fluid at a temperature $T_2 >> T_1$, in such a way that the coolant evaporates when comes in contact with the heating coil and the oil particles rimangano instead on the bottom of the hollow container body. The device also comprises a first oil barrier arranged above with respect to the heating coil and arranged to avoid that the oil particles schizino towards the outlet. is also provided a second oil barrier 114 located in the hollow container body at the outlet, said second oil barrier comprising holes having a diameter of a predetermined value D configured for preventing to oil particles of larger diameter to the predetermined value D of crossing the outlet.

8 Claims, 3 Drawing Sheets

DEVICE FOR SEPARATING OIL FROM A REFRIGERANT FLUID

CROSS-REFERENCE TO RELATED APPLICATIONS

This application is a national stage of International Application No. PCT/IB2016/051013, filed Feb. 24, 2016, which claims the benefit of priority to Italian Application No. PI2015A000010, filed Feb. 25, 2015, in the Italian Patent and Trademark Office, the disclosures of which are incorporated herein in their entireties by reference.

FIELD OF THE INVENTION

The present invention relates to an apparatus for recovering coolant of an air conditioning system.

In particular, the invention relates to a device for separation of residual oil by the coolant before the reintroduction of the fluid in the plant.

DESCRIPTION OF THE PRIOR ART

As well known, the coolant present in A/C systems, in particular those in vehicles such as cars, is periodically recovered and recycled to eliminate the impurities accumulated during the operation cycle. For this purpose, the coolant is taken from the air conditioning system by an apparatus for recovering and regenerating the coolant as described in WO2013179241A2.

In these types of machines coolant is subjected to a regeneration cycle in which it is depurated from the impurities present therein. One of these impurities to remove is the oil that is mixed to the coolant for operating the compressor during the recovery cycle.

Therefore, the crucial centre of the apparatus for recovering and regenerating the coolant is the evaporator-separator. Such element is a heat exchanger in which the coolant extracted from the A/C plant, in a predominantly liquid phase, is evaporated in order to allow a separation of oil.

In particular, the fluid to be purified absorbs heat by the treated coolant that comes from the compressor of the recovery apparatus and that, having been compressed, has a higher temperature. The treated fluid, at a higher temperature, may for example pass inside a heating coil located in the evaporator-separator. The liquid phase of the fluid to be purified, being in contact with the heating coil, evaporates while, owing to their higher evaporation temperature, the oil and the other impurities contained in the coolant does not evaporate and remain inside the evaporator.

Two examples of separation devices by evaporation of the coolant by the oil particles are shown in US2004000163A1 and in US2010269538A1.

However, in this type of devices there is normally the problem of an accumulation of oil particles at evaporator outlet holes, due, for example, of splashes produced by the high temperature of the fluid. Such particles can then contaminate again the regenerated gaseous coolant leaving the evaporator, reducing the efficiency of the evaporator-separator.

A solution is proposed in US2003196450A1 that describes an apparatus for recovering and regenerating the coolant comprising an oil separator 17 having a separation barrier 21 located in the upper part of the evaporation chamber 20, in order to reduce the oil particles that can splash towards the valve 2 from which the refrigerant in vapor phase flows out from the evaporation chamber 20.

However, in order to allow the coolant in vapor phase to rise up to the valve 2, the separation barrier 21 must leave free the passages 20*a*. Through such passages, some oil particles, transported by the coolant in vapor phase, can in any case go beyond the separation barrier 21 and thicken in the upper part of the evaporation chamber 20, escaping with the gaseous fluid that it is not completely regenerated. Dl puts a dry filter 30 downstream of the oil separator 17, but this filter 30 is used only for reducing the humidity present in the coolant and does not remove in any way the oil particles. Thus the coolant outgoing from the oil separator 17 comes to the compressor 11 carrying with it residual oil particles that accumulate with time, damaging the compressor itself and reducing the quality of coolant regeneration.

SUMMARY OF THE INVENTION

It is therefore a feature of the present invention to provide a device for separation of oil particles by a coolant that increases its efficiency with respect to the prior art devices, reducing the oil particles present in the regenerated coolant.

It is also a feature of the present invention to provide such a device that allows to monitor the residual presence of coolant in the separated oil.

It is a further feature of the present invention to provide such a device that has reduced weight and encumbrance.

These and other objects are achieved by a device for separation of oil particles by a coolant for air conditioning systems, said device comprising:

- a hollow container body defined by a top wall and a bottom wall;
- an inlet arranged to let enter the hollow container body a coolant with oil particles, said coolant being mainly in liquid phase and having a temperature $T_1$;
- an outlet located at said top wall and arranged to cause regenerated coolant in vapor phase to exit from the hollow container body;
- a heating unit, in the hollow container body, arranged to heat said coolant at a temperature $T_2 >> T_1$, in such a way that the coolant evaporates when it comes in contact with the heating unit and the oil particles can fall towards the bottom wall;
- a first oil barrier located between the heating unit and the outlet and arranged to prevent the oil particles to splash towards the outlet, said first oil barrier arranged at a distance L from said top wall;
- where a second oil barrier is also provided located in the hollow container body at the outlet, said second oil barrier comprising holes having a diameter of a predetermined value D, configured for preventing that oil particles having diameter larger than the predetermined value D pass through the outlet.

In particular, between the first oil barrier and the side wall of the hollow container body at least one rise way is provided arranged to allow the coolant in vapor phase to pass through towards the outlet.

This way, the oil particles that rise with the coolant in vapor phase through the rise way, on the contrary of the refrigerant itself, cannot overcome the holes present the second oil barrier and accumulate on the walls of it, creating large droplets that fall by gravity in the container body. This makes it possible to obtain a regenerated coolant in a way much most effective with respect to the prior art, avoiding problems in the compressing stage and providing a final product of higher quality. The advantage is still higher in case you have severe pressure and temperature conditions in the hollow container body.

In particular, the predetermined value D is comprised between 1μ and 10μ.

In particular, the second oil barrier is made of sintered bronze to allow a better precision of the piercing.

In particular, the predetermined value D is 5μ.

Advantageously, the predetermined value d is comprised between 1μ and 10μ.

Advantageously, the heating unit is a heating coil extending in the hollow container body and arranged to contain fluid at a temperature $T_2 >> T_1$, in such a way that the coolant evaporates when it comes in contact with the heating coil.

In particular, the first oil barrier comprises lateral slots arranged to allow inlet and outlet branches of the heating coil to cross the first oil barrier.

Advantageously, upstream of the inlet a cylindrical chamber is provided arranged to provide a pre-expansion of the coolant delivered to the hollow container body for lowering the flow speed and avoiding a coolant nebulization that would cause the oil particles to rise towards the outlet.

In particular, the cylindrical chamber is connected to the top wall and is arranged to support the first oil barrier at the distance L from the top wall.

In particular, in the hollow container body a pressure transducer is provided arranged to monitor the pressure in the hollow container body. This way, when the compressor that sucks the regenerated fluid towards the outlet is turned off, it is possible to monitor the pressure variation. If the pressure increases, it means that in the residual oil on the bottom of the hollow container body some gaseous refrigerant is still trapped and therefore it is necessary to reactivate the compressor to suck the refrigerant.

Advantageously, the top wall and the bottom wall are formed, respectively, by an upper flange and a lower flange, through the upper flange passing the coolant entering and exiting from the hollow container body.

BRIEF DESCRIPTION OF THE DRAWINGS

Further characteristic and/or advantages of the present invention are more bright with the following description of an exemplary embodiment thereof, exemplifying but not limitative, with reference to the attached drawings in which.

DESCRIPTION OF A PREFERRED EXEMPLARY EMBODIMENT

Figure 1:
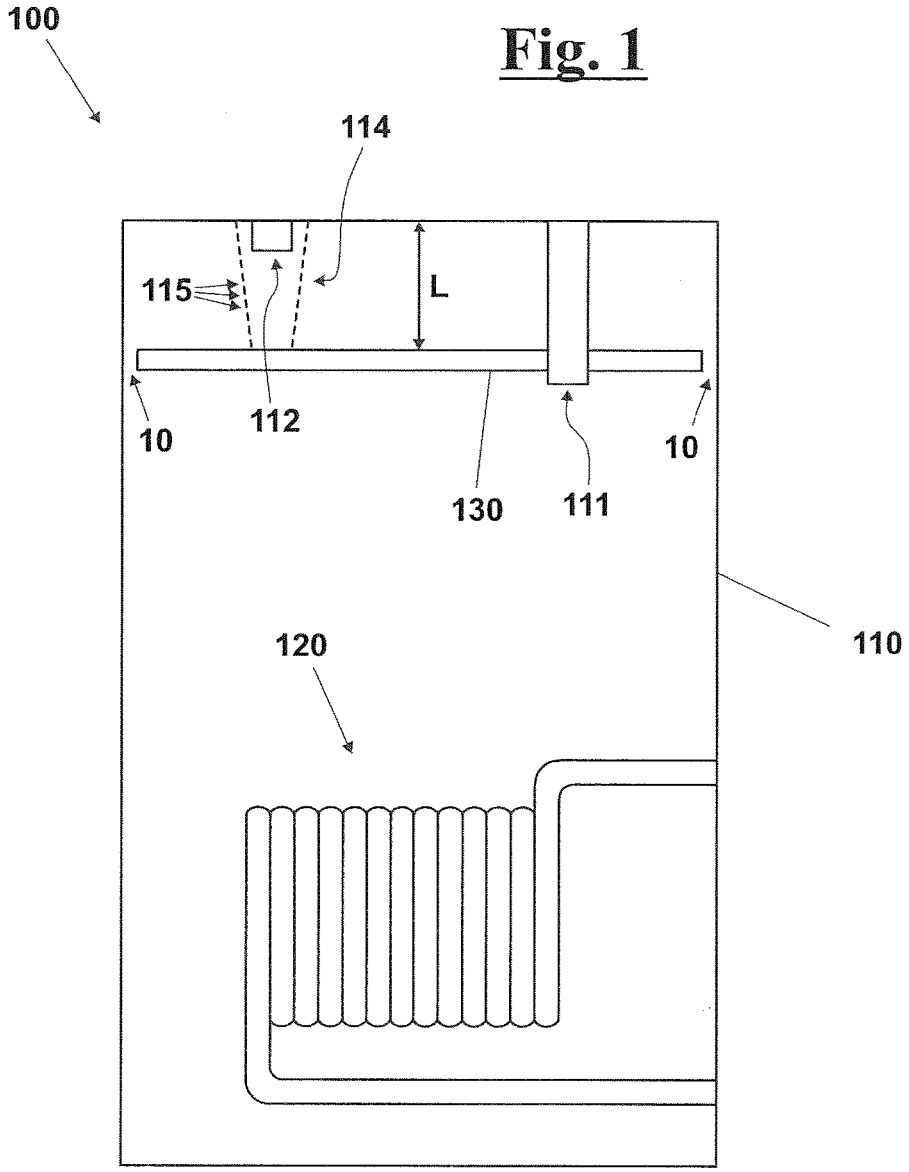
FIG. 1 shows schematically a first exemplary embodiment of the present invention.
Figure 2:
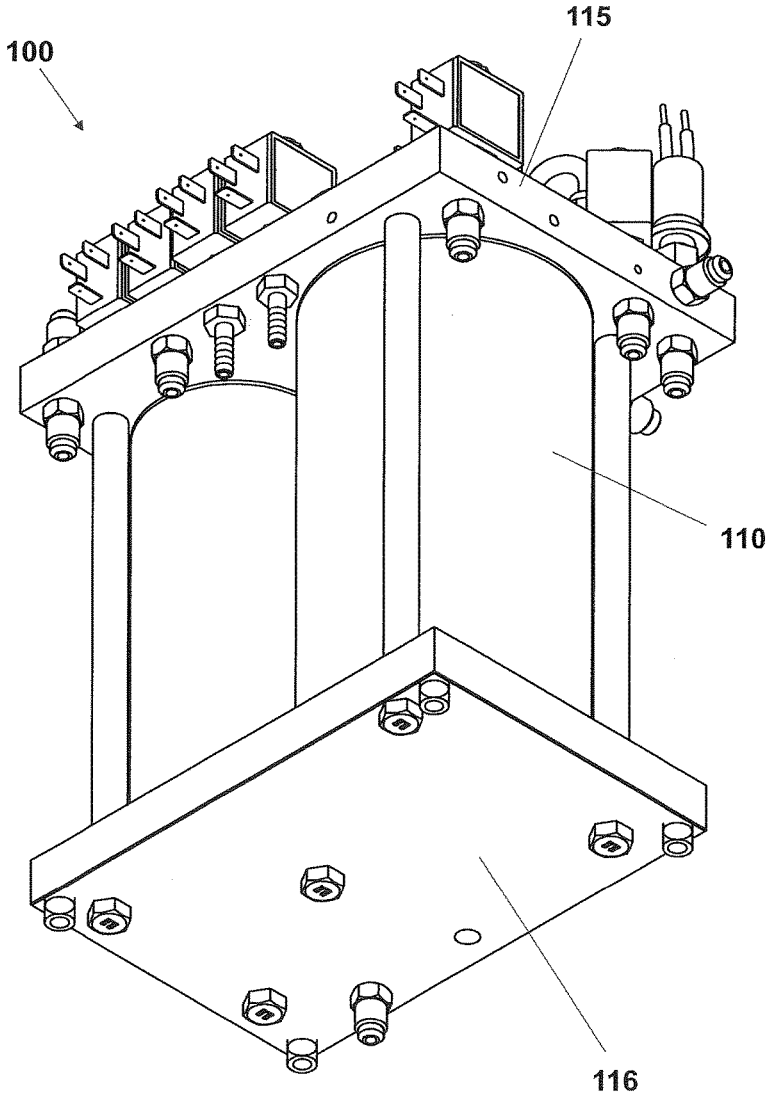
FIG. 2 shows, in perspective, an exemplary embodiment of the present invention where it is shown the outside of the hollow container body defined by the two flanges.

With reference to FIG. 1, in an exemplary embodiment of the present invention, the device 100 for separation of oil particles by a coolant for air conditioning systems comprises a hollow container body 110 inside which coolant to be regenerated is injected through an inlet 111. The entering fluid, containing oil particles and other impurities, is mainly in liquid phase and has a temperature $T_1$.

In the hollow container body 110 there is a heating coil 120 wherein fluid, for example fluid already regenerated, flows at a temperature $T_2 >> T_1$. The heating coil 120 is located in the lower part of the hollow container body 110, in such a way that the coolant to regenerate, mainly in liquid phase, depositing on the bottom by gravity, enters in contact with it. Due to the heat exchange between fluid and heating coil 120, the coolant evaporates, leaving on the bottom oil particles and any other impurities that have a higher evaporation temperature. The regenerated fluid in vapor phase rises then towards the upper part of the hollow container body 110 and exits through the outlet 112, due the suction of an external compressor.

The present invention also provides a first oil barrier 130, placed between the heating coil 120 and the outlet 112, at a distance L by the top wall of the hollow container body 110, arranged to protect the outlet 112 itself from oil particles that, for example, it can splash upwards while heating the coolant. In particular, between the first oil barrier 130 and the side wall of the hollow container body 110 there is at least one rise way 10 arranged to allow the coolant in vapor phase to pass through in order to reach the outlet 112.

Furthermore, the present invention provides a second oil barrier 114 located in the hollow container body 110 at the outlet 112. Such second oil barrier 114 comprises holes 115 having a diameter of a predetermined value D configured to prevent oil particles having diameter larger than this predetermined value D to cross the outlet 112.

This way, owing to the barrier 130 and 114 it is practically cleared the contamination of regenerated coolant by oil particles, thus increasing the efficiency of the regenerating process of the fluid and increasing the quality of the final product with respect to the prior art.

Figure 3:
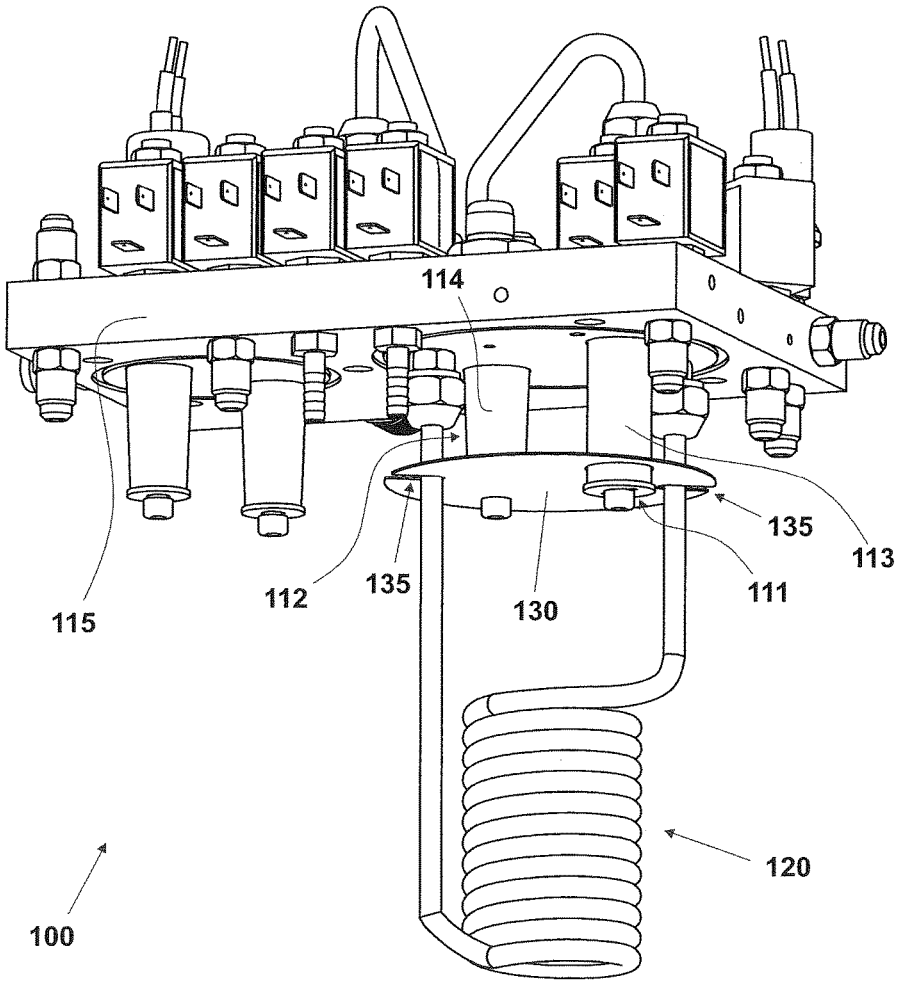
FIG. 3 shows, in perspective, the inner content of the hollow container body of the exemplary embodiment of FIG. 1.

In the exemplary embodiment of FIG. 3, the first oil barrier 130 comprises lateral slots 135 that allow to the heating coil 120 to cross the barrier itself. Such lateral slots 135 can also replace the rise way 10 in order to allow the passage of coolant in vapor phase towards the outlet 112, while retaining a large part of the oil particles on the surface of the barrier 130.

Alternatively, lateral slots 135 can be closed at the ends, allowing the passage of coolant in vapor phase only by the rise way 10.

In the exemplary embodiment of FIG. 3, the inlet 111 is located below the first oil barrier 130 and the entering coolant passes first through a cylindrical chamber 113 arranged to provide a pre-expansion of the fluid itself in order to decrease the speed of inlet in the hollow container body 110. This way, you avoid the nebulization of the coolant that could assist the rise of oil particles towards the outlet 112. Furthermore, the cylindrical chamber 113 can also serve as a spacer to maintain the barrier 130 at the distance L by the top wall of the hollow container body 110.

The foregoing description some exemplary specific embodiments will so fully reveal the invention according to the conceptual point of view, so that others, by applying current knowledge, will be able to modify and/or adapt in various applications the specific exemplary embodiments without further research and without parting from the invention, and, accordingly, it is meant that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. A device for separation of oil particles by a coolant for air conditioning systems, said device comprising:

a hollow container body defined by a top wall and a bottom wall;

an inlet arranged to let enter said hollow container body a coolant with oil particles, said coolant being mainly in liquid phase and having a temperature $T_1$;

an outlet located at said top wall and arranged to cause regenerated coolant in vapor phase to exit from said hollow container body;

a heating unit, in said hollow container body, arranged to heat said coolant at a temperature $T_2 >> T_1$, in such a way that said coolant evaporates when it comes in contact with said heating unit and said oil particles can fall towards said bottom wall;

a first oil barrier located between said heating unit and said outlet and arranged to prevent said oil particles to splash towards said outlet, said first oil barrier arranged at a distance L from said top wall;

said device characterized in that it also comprises a second oil barrier located in said hollow container body at said outlet, said second oil barrier comprising holes having a diameter of a predetermined value D, configured to prevent that oil particles having diameter larger than said predetermined value D pass through said outlet.

2. The device, according to claim 1, wherein, at said outlet, a labyrinth is provided configured to allow said coolant in vapor phase to pass through, in order to reduce the liquid component of oil that reaches said outlet.

3. The device, according to claim 1, wherein said heating unit is a heating coil extending within said hollow container body and arranged to contain fluid at a temperature $T_2 >> T_1$, in such a way that said coolant evaporates when it comes in contact with said heating coil.

4. The device, according to claim 3, wherein said first oil barrier comprises lateral slots arranged to allow inlet and outlet branches of said heating coil to cross said first oil barrier.

5. The device, according to claim 1, wherein upstream of said inlet a cylindrical chamber is provided arranged to provide a pre-expansion of the coolant delivered to said hollow container body for lowering the flow speed and avoiding a coolant nebulization that would cause the oil particles to rise towards said outlet.

6. The device, according to claim 5, wherein said cylindrical chamber is connected to said top wall and is arranged to support said first oil barrier at said distance L from said top wall.

7. The device, according to claim 1, wherein in said hollow container body a pressure transducer is provided arranged to monitor the pressure in said hollow container body.

8. The device, according to claim 1, wherein said top wall and said bottom wall are formed, respectively, by an upper flange and a lower flange, through said upper flange passing said coolant entering and exiting from said hollow container body.

* * * * *